US005227573A

United States Patent [19]

Nakano

[11] Patent Number: 5,227,573

[45] Date of Patent: Jul. 13, 1993

[54] CONTROL VALUE OUTPUT APPARATUS WITH AN OPERATION MEMBER FOR CONTINUOUS VALUE CHANGE

[75] Inventor: Seiji Nakano, Hamamatsu, Japan

[73] Assignee: Kabushiki Kaisha Kawai Gakki Seisakusho, Shizuoka, Japan

[21] Appl. No.: 717,463

[22] Filed: Jun. 19, 1991

[30] Foreign Application Priority Data

Jun. 25, 1990 [JP] Japan ..... 2-166077

[51] Int. Cl.[5] ..... G10H 1/06; G10H 1/42; G10H 1/46

[52] U.S. Cl. ..... 84/622; 84/633; 84/636; 84/645

[58] Field of Search ..... 84/615, 626, 633, 645, 84/658, 665, 687-690, 711, 741, DIG. 10, DIG. 19, 609-614, 622-625, 634-638, 649-652, 659-661, 666-669; 369/47-51

[56] References Cited

U.S. PATENT DOCUMENTS

Re. 30,834 12/1989 Niimi et al. ..... 84/DIG. 10
4,361,069 11/1982 Peterson et al. ..... 84/DIG. 19
5,005,460 4/1991 Suzuki et al. ..... 84/615 X

*Primary Examiner*—Stanley J. Witkowski

[57] ABSTRACT

A control value output apparatus for controlling a controllable value such as a tone volume value which can be continuously changed upon operation of an operation member of an operation unit for supplying a control value, comprises an output unit for holding a control value. A data source supplies a predetermined or preset control value to the output unit. The control value held in the output unit and the control value supplied from the operation unit are compared and when a coincidence output is generated, the output unit holds the control value from the operation unit in place of the presently held control value, and the output control value follows an operation position of the operation member.

18 Claims, 5 Drawing Sheets

OPERATION OF SLIDER

VARIATION OF VOLUME

VARIATION OF VOLUME ACCORDING TO OPERATION OF SLIDER

CONTROL VALUE OUTPUT APPARATUS WITH AN OPERATION MEMBER FOR CONTINUOUS VALUE CHANGE

BACKGROUND OF THE INVENTION

1. Field of the Invention

The present invention relates to a control value output apparatus for controlling an output of, e.g., tone volume by a movable operation member such as a slider provided to a slide volume member.

2. Description of the Prior Art

In electronic equipment such as audio and video equipment (e.g., an electronic musical instrument), a slide volume member 1 is often arranged on an operation panel, as shown in FIG. 6.

The slide volume member 1 is used to control an output such as a tone volume within a predetermined range (a range of 0 to 127 in FIG. 6) by reciprocating a "slider" 2 along a slit 3 to adjust a variable resistor arranged in the slide volume member 1 in accordance with the position of the slider 2. In addition to the tone volume member, outputs to be controlled by the slide volume 1 include a tempo of a music piece, an interval, a tone color, and the like in audio equipment, and luminance, contrast, and the like of a screen in a video equipment.

As shown in FIG. 6, operation buttons 4 and 5 for incrementing/decrementing the same output, step by step a are often arranged on the operation panel on which the slide volume member 1 is arranged. Once the operation button 4 or 5 is depressed, for example, a presently output tone volume is incremented/decremented by one step. When the button is continuously depressed, the tone volume is continuously incremented/decremented.

In an electronic musical instrument, an output such as tone volume is controlled on the basis of, e.g., tone volume data included in preset data or tone data such as auto-accompaniment tone data regardless of the position of the slider 2.

When one output value can be independently changed by the slide volume member 1 and other operation members 4 and 5, or another control element such as setup data like in the above-mentioned prior art, the following problems are posed.

FIGS. 5A and 5B exemplify tone volume as an output, and show the movement of the slider 2 of the slide volume member 1, and variations of the tone volume. Assume that the slider 2 is held at a position of a volume value "40" from time $t_0$ to time $t_3$, as shown in FIG. 5A. As shown in FIG. 5B, tone volume of the volume value "40" is output in accordance with the position of the slider 2 from time $t_0$ to time $t_1$. During a time interval between time $t_1$ and time $t_2$, the incremental operation button 4 (FIG. 6) is continuously depressed to increase the tone volume up to a volume value "80", and the tone volume of the volume value "80" is held until time $t_3$. In this case, when the slider 2 is operated at time $t_3$, and is moved from the position of the volume value "40" in a direction to increase the value, the tone volume of the volume value "80" output so far is temporarily and instantaneously decreased to the volume value "40" corresponding to the held position of the slider 2, and then begins to be increased from the value "40" in accordance with the movement of the slider 2.

In contrast to this, when the decremental operation button 5 is continuously depressed to set the volume value "80" in a state wherein the slider 2 is located at a position indicating a value larger than the volume value "80", and the slider 2 is moved in a direction to decrease the value, the volume value of the tone volume is temporarily instantaneously increased up to a value corresponding to the position at the beginning of the movement of the slider 2.

As described above, when one volume value is to be independently controlled by the slider 2 of the slide volume member 1, and other volume control elements such as incremental/decremental operation buttons 4 and 5, a tone is abruptly changed at an instance when the slider 2 is moved, resulting in aurally unnatural sound.

Since the slide volume member 1 is mechanically arranged, the slider 2 is often unexpectedly moved by, e.g., a vibration, and in this case, the output is also abruptly changed.

SUMMARY OF THE INVENTION

It is an object of the present invention to provide an output apparatus which can eliminate an abrupt variation of an output when a movable operation member is operated, and can smoothly vary an output from a present control value.

An output apparatus according to the present invention comprises an output unit for holding a control value, and outputting the held control value, a data source for supplying one predetermined control value to the output unit, an operation unit for supplying a control value which is continuously changed upon operation of an operation member, and comparison means for comparing the control value held in the output unit, and the control value supplied from the operation unit, and for, when the two control values are almost equal to each other, generating a coincidence output. The output unit holds the control value from the operation unit in place of the presently held control value in response to the coincidence output, and outputs a control value which follows an operation position of the operation member.

Therefore, as indicated by a solid curve in FIG. 5C, a smooth variation of an output free from an abrupt variation of an output value can be obtained.

DETAILED DESCRIPTION OF THE PREFERRED EMBODIMENT

An embodiment of the present invention will be described below with reference to the accompanying drawings.

Figure 1:
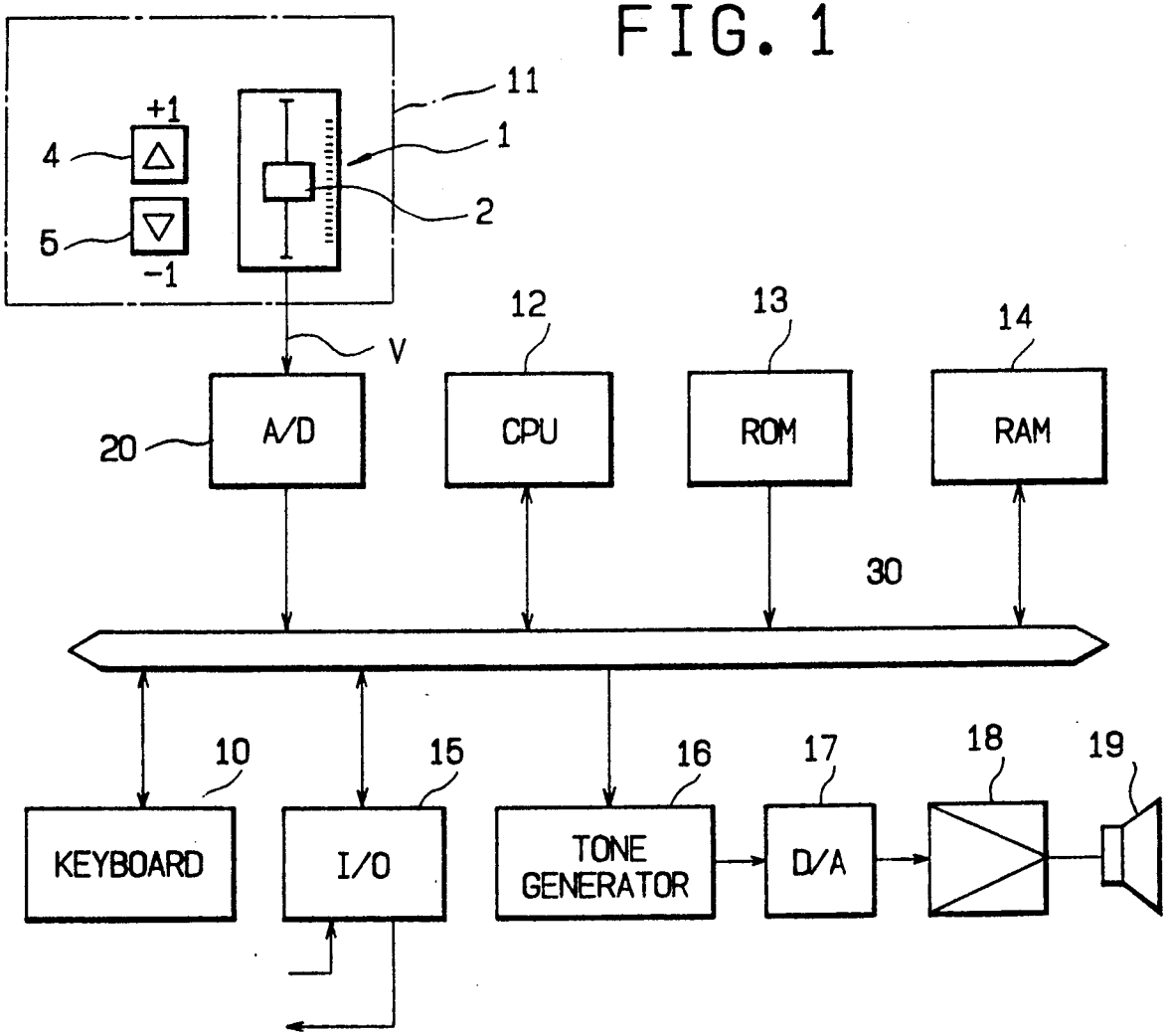
FIG. 1 is a block diagram for explaining a schematic arrangement of an electronic musical instrument to which an output control apparatus of the present invention is applied.

FIG. 1 is a block diagram for explaining a schematic arrangement of an electronic musical instrument to which an output control apparatus of the present invention is applied.

In FIG. 1, a keyboard unit 10, an operation panel unit 11, a CPU 12, a program & data ROM 13, a RAM 14, an I/O 15, and a tone generator 16 are connected to a bus line 30 including, e.g., a data bus, an address bus, and the like, and can communicate with each other.

The keyboard unit 10 comprises a keyboard (not shown) on which a plurality of keys are aligned, an interface (not shown) for receiving signals from the keys on the keyboard, and the like.

Various tone control and performance control operation members, an interface (not shown) for receiving signals from the operation members, a display (not shown) for displaying various data, and the like are arranged on the operation panel unit 11. In addition, the above-mentioned slide volume member 1, and the incremental/decremental operation buttons 4 and 5 are also arranged on the operation panel unit 11. In this embodiment, the slide volume member 1 controls an output from an amplifier 18, i.e., a tone volume, and the incremental/decremental operation buttons 4 and 5 are operation members which can control a tone volume regardless of the position of the slider 2 of the slide volume 1.

A voltage V indicating one of 0th to 127th steps is obtained from the slide volume member 1 in accordance with the position of the slider 2. The voltage V is converted into digital data by an A/D converter 20, and the digital data is supplied to the CPU 12.

The CPU 12 executes scan processing of the keys on the keyboard unit 10, and scan processing of the operation members of the operation panel unit 11, and executes various processing operations for tone generation according to a program stored in the ROM 13 in accordance with operations of the keys on the keyboard unit 10, and the operation members on the operation panel unit 11.

The ROM 13 stores the work program for the CPU 12, tone waveform data, display data for the display, automatic performance pattern data, and the like.

The RAM 14 serves as a work memory used in data processing by the CPU 12, and various variables (registers) for storing various data are allocated on the RAM 14.

The I/O 15 is an input/output unit to which an external equipment such as another electronic musical instrument, an external storage device, or the like can be connected.

The tone generator 16 comprises a plurality of tone generation channels for generating tone signals corresponding to a piano, a violin, and the like, and forms a tone signal having a predetermined frequency, waveform, amplitude, sustain time, and the like on the basis of a tone control signal from the CPU 12. The tone signal is converted into an analog tone signal by a D/A converter 17, and the analog tone signal is amplified by the amplifier 18. Thereafter, the amplified signal is reproduced by a loudspeaker 19.

Figure 2:
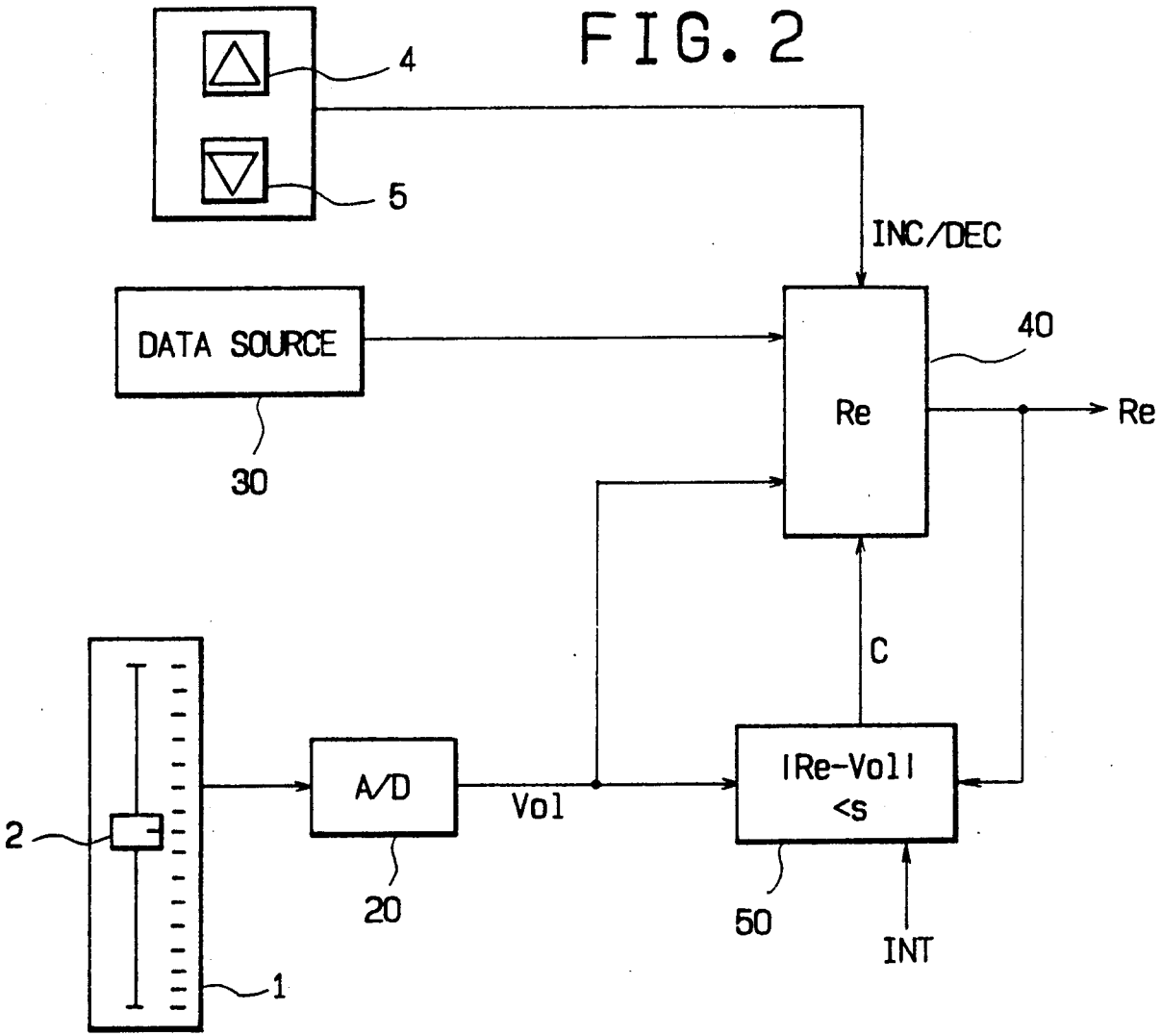
FIG. 2 is a block diagram showing the characteristic feature of the constituting elements of the present invention.

FIG. 2 is a block diagram showing the principle elements of the present invention. In FIG. 2, a data source 30 represents another electronic musical instrument or an external storage device connected through the I/O 15 shown in FIG. 1, or an internal memory, and supplies automatic performance data or MIDI data. An output unit 40 stores a tone volume preset value in the performance data as a control value Re, and sends the stored value to the tone generator 16 in FIG. 1.

The control value Re in the output unit 40 can be incremented or decremented in response to a signal INC/DEC from the operation member 4 or 5.

The output value from the slide volume 1 is converted into a tone volume member control value Vol by the A/D converter 20, and the control value is supplied to a comparator 50. The comparator 50 compares the present control value Re held in the output unit 40, and the tone volume control value Vol by the slide volume member 1, and if the absolute value of the difference between the two values falls within a small value s, outputs a coincidence output C. The comparator 50 is enabled by a signal INT (interrupt) generated at predetermined intervals.

When the coincidence output C is generated, the tone volume control value Vol from the A/D converter 20 is held in the output unit 40 in place of the present control value Re held in the output unit 40. Thereafter, a tone volume control value following the operation position of the slider 2 of the slide volume member 1 is held in the output unit 40, and the held value is output to the tone generator 16.

The operation of the above arrangement will be described below.

Figure 3:
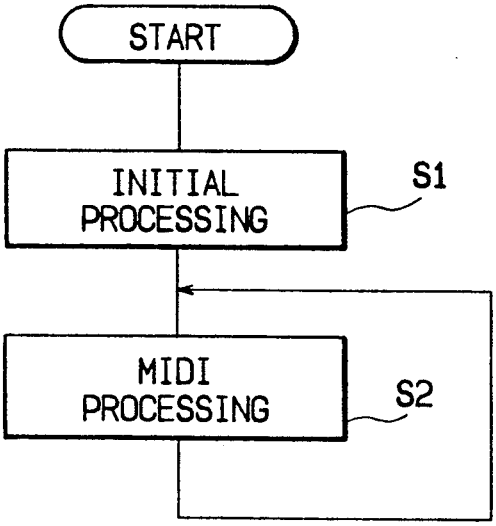
FIG. 3 is a flow chart for explaining main processing executed by a CPU.

FIG. 3 is a flow chart for explaining main processing executed by the CPU 12.

When the power switch of the electronic musical instrument is turned on, the CPU 12 executes initial processing in step S1. In this processing, the CPU 12 initializes a sound generator, resets variables (registers) in the RAM 14 to initial values, and so on.

In step S2, the CPU 12 executes MIDI processing. In this processing, the CPU 12 executes scan processing for checking operation states of all the keys on the keyboard unit 10, and all the operation members on the operation panel unit 11, and executes generation processing of tones in accordance with operations of the keys and the operation members, and control processing of a tempo, a tone volume, and the like.

The data source 30 in FIG. 2 corresponds to the ROM 13 in FIG. 1. When an automatic performance is performed on the basis of programmed automatic performance data stored in the ROM 13, the CPU 12 reads out the automatic performance data from the ROM 13 in the MIDI processing, and then executes processing for generating corresponding tones from the loudspeaker 19 on the basis of the readout data. The automatic performance data includes tone volume control data, and the tone volume control data is written in the output unit 40 (register Re) in FIG. 2.

Furthermore, the data source 30 in FIG. 2 includes an MIDI signal sent from another electronic musical instrument. When a tone signal sent from another electronic musical instrument is to be reproduced, the CPU 12 also executes processing for generating corresponding tones from the loudspeaker 19 on the basis of MIDI-standard tone signals sent from the other electronic musical instrument via the I/O 15. Tone volume control data in the MIDI signal is written in the output unit 40.

The MIDI processing in step S2 is repetitively executed.

Figure 5A:
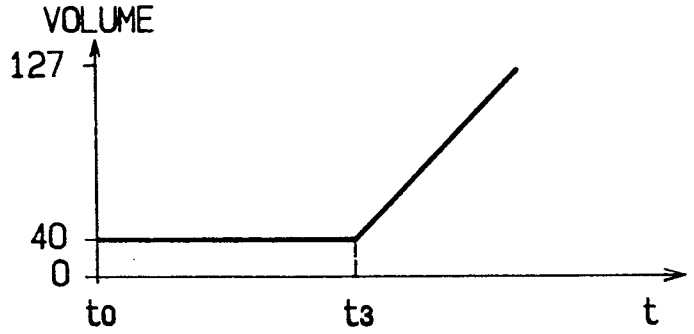
FIGS. 5A to 5C are graphs showing the movement of a slider, and variations of an output in the prior art and the present invention.
Figure 5B:
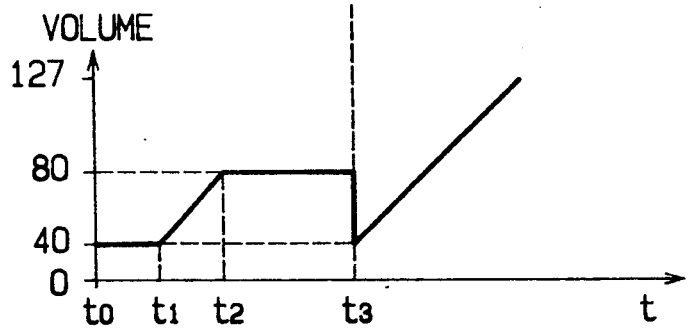
FIG. 5B (PRIOR ART)
Figure 5C:
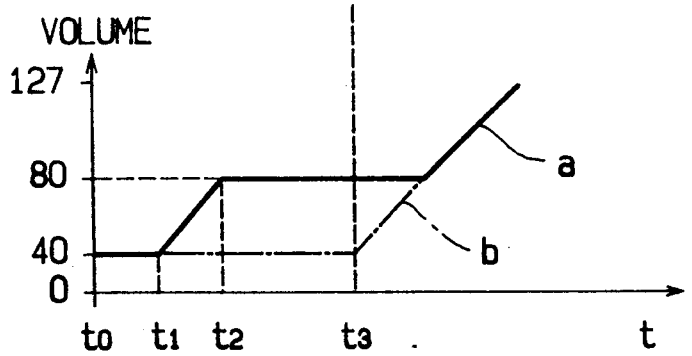
Figure 6:
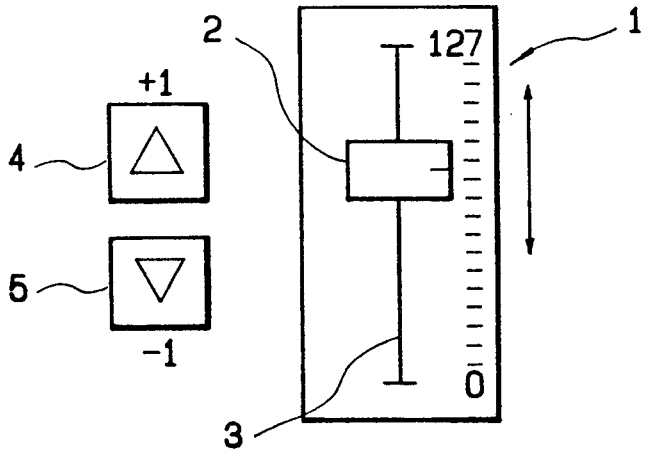
FIG. 6 is a plan view showing a slide volume, and incremental/decremental operation buttons.

Assume that the slider 2 of the slide volume 1 is located at the position of a volume value "40", and the tone is output in a tone volume of the volume value "40". It is also assumed that after the above-mentioned state continues between time $t_0$ and time $t_1$, the volume value is increased from "40" to "80" between time $t_1$ and time $t_2$ upon operation of the incremental/decremental operation buttons 4 and 5, and the state of "80" continues up to time $t_3$, as indicated by a solid curve a in FIG. 5C. In this case, when the slider 2 is moved at time $t_3$ from the position corresponding to the volume value "40" in a direction to increase the value, as indicated by an alternate long and short dashed curve b in FIG. 5C, in this embodiment, the tone volume is held at "80" until the slider 2 is moved from the position of the volume value "40" to the position indicating the present actual volume value "80", and the holding state is released when the slider 2 reaches a position almost corresponding to the volume value "80". Thereafter, the tone volume is controlled to have a volume value according to the position of the slider 2. Thus, although the movement of the slider 2 is the same as that of the conventional slider 2 in FIG. 5A, as indicated by the curve b in FIG. 5C, an actual variation of the tone volume can be free from an abrupt variation at time $t_3$ in FIG. 5B, as indicated by the curve a. As a result, the tone volume can be smoothly varied.

Figure 4:
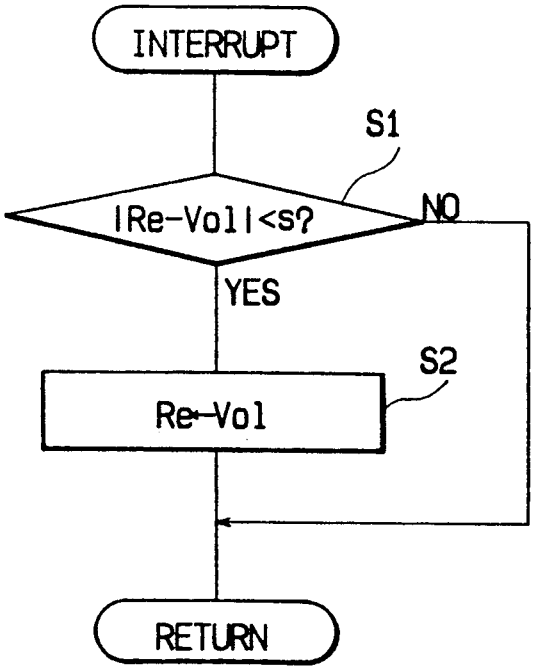
FIG. 4 is a flow chart for explaining interrupt processing executed by the CPU.

FIG. 4 is a flow chart of processing executed by the CPU 12 in order to perform the above-mentioned operations (control.

This processing is executed by the CPU 12 as interrupt processing.

In this processing, the CPU 12 checks in step S1 if the absolute value of the difference between the volume value Re of the present tone volume (i.e., a value held in the register Re in the RAM 14) and the volume value Vol indicated by the slider 2 is smaller than a small reference value s. If NO in step S1, the flow returns to the main processing. The processing returning to the main processing is repetitively executed until the slider 2 approaches a position corresponding to the present volume value ("80" in FIG. 5C). Therefore, during this interval, the present tone volume ("80") is held. If it is determined in step S1 that the absolute value of the difference between the volume values Re and Vol is smaller than s, the flow advances to step S2, and the present volume value Re is replaced with the volume value Vol indicated by the position of the slider 2 (i.e., the value of the variable Re in the RAM 14 is replaced with the volume value Vol indicated by the slider 2). Thereafter, the flow returns to the main processing. More specifically, in step S2, a holding state of the present tone volume is released when the difference between the volume values Re and Vol becomes smaller than s, and the tone volume is controlled to the value Vol corresponding to the position of the slider 2. Note that tone volume control based on the new volume value Vol written in the register Re is executed in the MIDI processing in step S2 in the main processing shown in FIG. 3 after the control escapes from this interrupt processing.

As described above, according to the above embodiment, the present volume value Re is set using the incremental/decremental operation buttons 4 and 5, and even when a difference is present between the present volume value Re and the volume value Vol indicated by the position of the slider 2 of the slide volume 1, an abrupt variation of the tone volume upon operation of the slider 2 of the slide volume 1 can be prevented.

Even when the slider 2 is unexpectedly moved by vibration, a variation of the tone volume can be suppressed within a range of the small value s.

The embodiment of the present invention has been described above. However, the present invention is not limited to the above embodiment, and various effective modifications may be made based on the technical idea of the present invention.

For example, in the above embodiment, the movable operation member comprises the slider 2. However, the movable operation member may comprise a rotary operation member arranged in, e.g., a rotary volume.

In the above embodiment, if the difference between the present volume value Re and the volume value Vol indicated by the position of the slider 2 is larger than s, the present volume value Re is left unchanged even when the slider 2 is operated. The difference serving as a reference value for determining whether or not the present volume value Re is changed in accordance with an operation of the slider 2 may be set to be various values equal to or larger than 1. In this case, when the slider 2 is moved fast, the value may be changed by 1 or more at a time. Thus, a comparison reference value s must be set to be larger than a possible maximum change.

In the above embodiment, the incremental/decremental operation buttons 4 and 5 have been exemplified as control elements other than the slide volume 1, which can control a tone volume. However, various other control elements such as tone volume data in automatic performance data stored in a memory such as the ROM 13, tone volume data included in a tone signal sent, through the I/O 15, from another electronic musical instrument, an external storage device, or the like, tone volume control setup data stored in, e.g., the ROM 13 or the RAM 14, other operation members which can control a tone volume, and the like may be used.

In the above embodiment, the tone volume is controlled using the movable operation member. However, the present invention is similarly applicable to a case wherein a tempo, an interval, a tone color, or the like is controlled by the movable operation member. Furthermore, the present invention can be widely applied to electronic equipments such as audio and video equipments other than the electronic musical instrument.

According to the present invention, when the movable operation member is moved to a position corresponding to the present control value, the holding of the control value by the output unit is released, and a control value following the operation position of the operation member is output. Therefore, even when the present control value is offset from the value at the beginning of movement of the movable operation member, an output can be prevented from being abruptly changed, and a smooth variation of an output can be obtained. Even when the operation member is unexpectedly moved by vibration, an abrupt variation of an output can also be suppressed.

What is claimed is:

1. A control value output apparatus comprising:

output means for holding a first control value, and outputting the first control value;

data source means for supplying the first control value to said output means;

operation means for supplying a second control value which is continuously changed, by operation of an operation member; and comparison means for comparing the first control value held in said output means and the second control value supplied from said operation means, and for generating a coincidence output, when the two control values are within a predetermined value;

wherein said output means holds the second control value from said operation means in response to the coincidence output, and outputs a new control value which corresponds to an operation position of said operation member.

2. The apparatus of claim 1, wherein said comparison means is initiated at predetermined time intervals.

3. The apparatus of claim 1, wherein said comparison means detects that a difference between the first control value held in said output means, and the second control value supplied from said cooperation means is within a predetermined range.

4. The apparatus of claim 1, wherein the operation member is a variable resistor and said operation means includes and A/D converter for forming a digital value corresponding to a resistance of said variable resistor.

5. The apparatus of claim 4, wherein said variable resistor includes a slide type variable resistor.

6. The apparatus of claim 1, wherein the first and second control values are tone volume control values, and said data source supplies the first control value from MIDI data received from an electronic musical instrument.

7. The apparatus of claim 1, wherein the first and second control values are tone volume control values, and said data source supplies the first control value from automatic performance data received from an electronic musical instrument.

8. The apparatus of claim 1, further comprising incrementing/decrementing means for incrementing-/decrementing the first control value held in said output means by a predetermined step width.

9. The apparatus of claim 1, wherein said output means includes a register for storing.

10. A control value apparatus for an electronic musical instrument for smoothly controlling variations in a musical tone comprising:

first data source means for receiving a first control value;

holding means for holding the first control value and outputting the first control value to a tone generator;

first varying means for varying the first control value;

said holding means holding the varied first control value and outputting the varied first control value to said tone generator;

second data source means for providing a second control value;

comparing means for comparing the second control value and the varied first control value and if a difference between the second control value and the varied first control value is less than a predetermined value, said holding means holding the second control value and outputting the second control value to said tone generator; and second varying means for varying the second control value if the difference between the second control value and the varied first control value is greater than or equal to the predetermined value such that the difference is less than the predetermined value;

said holding means holding the varied second control value and outputting the varied second control value to said tone generator.

11. The control value apparatus of claim 10, wherein said first varying means is a increment/decrement button.

12. The control value apparatus of claim 10, wherein said first varying means is a read only memory and the first control value is received as part of automatic performance data.

13. The control value apparatus of claim 10, wherein said first varying means is a second electronic musical instrument and the first control value is received as part of MIDI data.

14. The control value apparatus of claim 10, wherein the first control value represents tone volume of the musical tone.

15. The control value apparatus of claim 10, wherein the first control value represents tempo of the musical tone.

16. The control value apparatus of claim 10, wherein the first control value represents an interval of the musical tone.

17. The control value apparatus of claim 10, wherein the first control value represents tone color of the musical tone.

18. The control value apparatus of claim 10, said second data source means including a variable resistor.

* * * * *